US006949998B2

(12) United States Patent
Lecomte

(10) Patent No.: US 6,949,998 B2
(45) Date of Patent: Sep. 27, 2005

(54) APPARATUS FOR MOTOR PROTECTION AND CONTROL

(75) Inventor: René Lecomte, Argenteuil (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 344 days.

(21) Appl. No.: 10/331,727

(22) Filed: Dec. 31, 2002

(65) Prior Publication Data

US 2003/0123202 A1 Jul. 3, 2003

(30) Foreign Application Priority Data

Jan. 2, 2002 (FR) ..... 02 00018

(51) Int. Cl.[7] ..... H01H 67/02
(52) U.S. Cl. ..... 335/132; 335/174
(58) Field of Search ..... 335/131–132, 335/159–161, 6, 202, 165–195; 200/401

(56) References Cited

U.S. PATENT DOCUMENTS 4,400,670 A 8/1983 Islam ..... 335/6
5,252,933 A 10/1993 Kamino et al. ..... 335/172
5,546,062 A * 8/1996 Duchemin ..... 335/132
5,594,399 A * 1/1997 Blanchard et al. ..... 335/132
5,605,224 A 2/1997 Seymour et al. ..... 200/401
6,307,455 B1 * 10/2001 Dolo et al. ..... 335/172
6,577,215 B2 * 6/2003 Nomura et al. ..... 335/132

FOREIGN PATENT DOCUMENTS

EP 0 292 852 A2 11/1988
FR 2 799 574 4/2001

* cited by examiner

*Primary Examiner*—Lincoln Donovan
(74) *Attorney, Agent, or Firm*—Steptoe & Johnson LLP

(57) ABSTRACT

Apparatus for motor protection and control including power conductors including poles with separable contacts, a trip mechanism connected to an electromagnet, a mechanical device, a connecting strip and a manual control button, a protection device including means for detecting currents flowing through the power conductors and means for generating an initiating signal to control the trip mechanism, the electromagnet and the mechanical device, wherein the mechanical device is for actuating the separable contacts and the connecting strip, and the manual control button is for actuating the mechanical device, wherein the mechanical device includes means for automatically resetting the trip mechanism after the trip mechanism has tripped and means for returning the mechanical device to an OFF position.

6 Claims, 3 Drawing Sheets

APPARATUS FOR MOTOR PROTECTION AND CONTROL

The present invention relates to an apparatus for motor protection and control of the starter type, containing power conductors provided with poles with separable contacts and a protection device fitted with means of detecting currents flowing through the power conductors and means for generating an initiating signal for controlling an electromagnet and a mechanical trip device which is able to operate the moving contacts and a connecting strip and which can be operated by a manual control button.

Motor protection and control can be provided by a combination of a contactor and a thermal relay. The contactor provides the motor automatic control function, notably when starting and stopping. The thermal relay, of the bimetallic strip or electronic type, protects not only the circuit but also the contactor against current overloads. Protection against short-circuits can be provided by fuses installed on the input side of the contactor-thermal relay assembly. Such a combination is described, for example, in documents U.S. Pat. Nos. 5,684,342, 5,699,222, 5,706,153.

There is also a magnetic circuit breaker-contactor-thermal relay assembly installed in the same housing and known under the name "combined starter". The standard NEMA ICS2 describes such an assembly and documents U.S. Pat. Nos. 4,088,973, 5,822,164, illustrate examples of such assemblies.

Document WO 01/27958 describes an apparatus for motor protection and control containing poles with separable contacts and, for controlling these contacts, a control electromagnet and a protection device with which is associated a trip mechanism. The trip mechanism is able to actuate the contacts under the action of an electromagnetic release device and it can be reset by a manual control button which can also be used for controlling the opening and closing of the contacts.

The purpose of the invention is to produce a combined starter apparatus of modular structure and capable of communicating with its environment.

The motor protection and control apparatus according to the invention is characterised by the fact that the mechanical device has means for resetting the trip device automatically after initiation and for moving it to the stop position.

According to one characteristic, the apparatus has on its front face a locking cursor which can occupy a locked position that prevents the protection device from being pulled out and an unlocked position that makes it possible to extract the protection device and in which the rocker arm is displaced so as to operate the connecting strip and a signalling contact associated with this connecting strip.

The invention will now be described in greater detail by referring to one embodiment given by way of example and illustrated by the annexed drawings in which.

Figure 1:
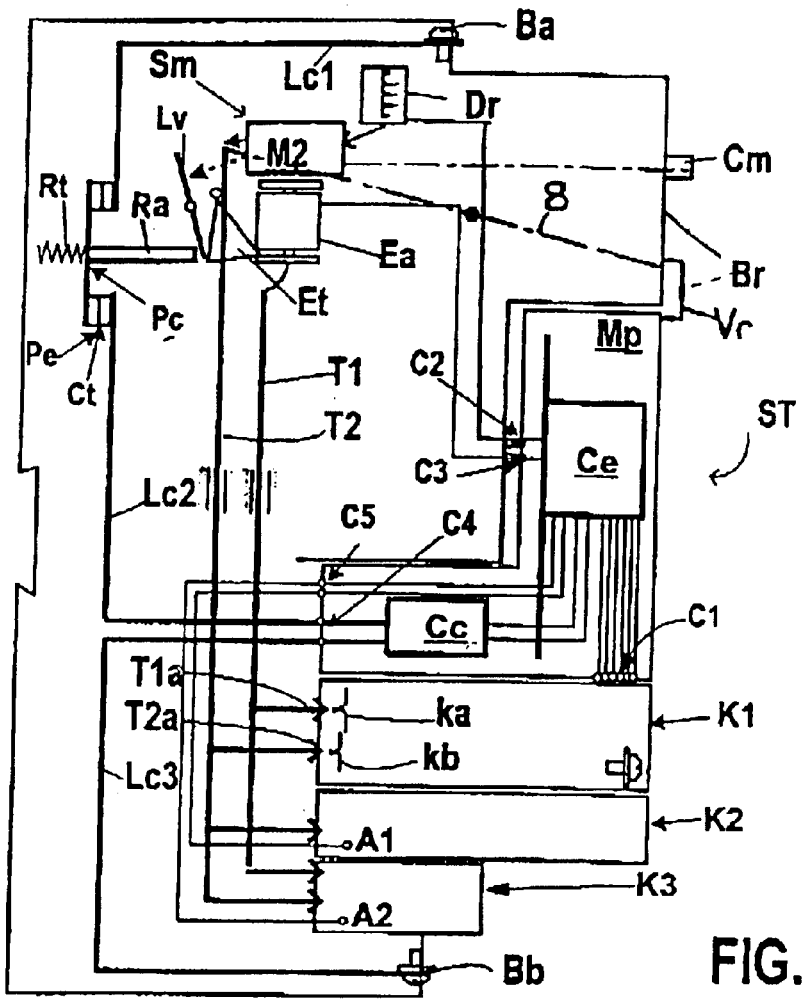
FIG. 1 is a side view diagram of an apparatus according to the invention.
Figure 2:
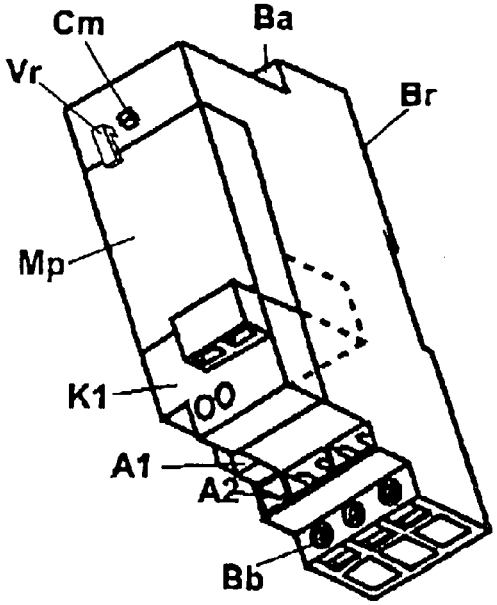
FIG. 2 is a perspective view of the apparatus illustrated in FIG. 1.
Figure 3:
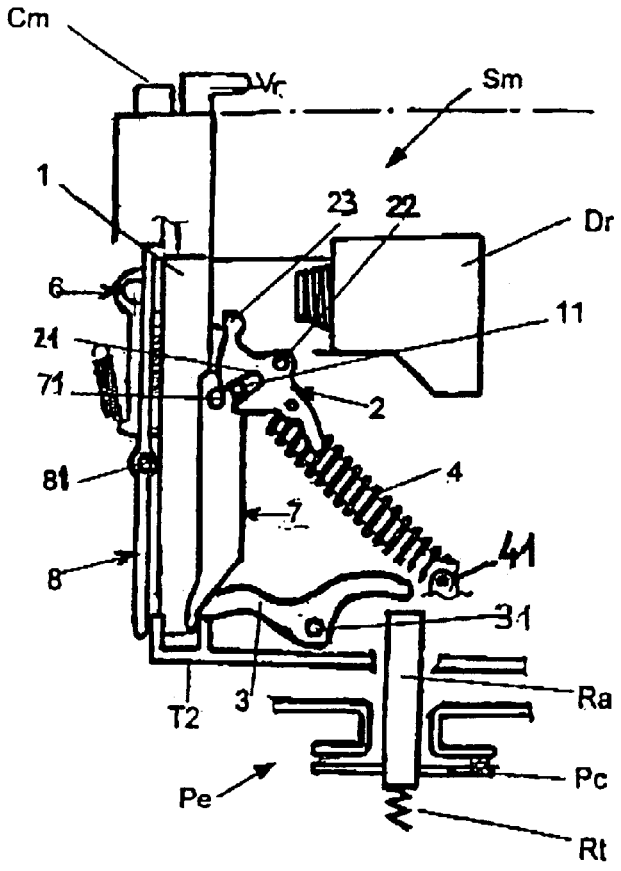
FIG. 3 represents the mechanical sub-assembly of the apparatus in the "on" state.
Figure 7:
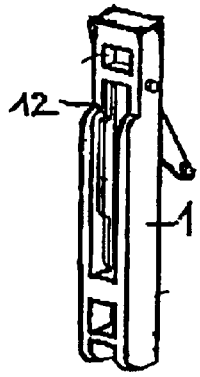
FIGS. 7 and 8 represent a detail of the mechanical sub-assembly.

The apparatus of the combined starter type which is referenced ST in FIG. 1 consists of a case Br housing the current-carrying lines, each such line being associated with a chamber and a cut-off pole Pe, which, preferentially, is composed of a double cut-off bridge Pc mounted in contact-holder Ra and having moving contacts Ct mating with the fixed contacts provided on the power lines. This bridge is subjected to the action of a spring Rt. FIG. 1 shows only a single pole although the apparatus is a multipole device.

A power terminal block Ba is arranged at the upper part of case Br in order to connect the power lines to a power supply. A terminal block Bb is arranged at the lower part in order to connect the power lines to a load.

The poles Pe are operated in contactor mode by an electromagnet Ea housed in the upper part of the case.

A mechanical sub-assembly Sm housed in case Br operates contacts Ct in order to cause them to open or close. This sub-assembly Sm contains a mechanism M2 on which manual control button Cm and a trip mechanism Dr act. Poles Pe can be opened and closed by the manual control button Cm placed on the front face of the apparatus.

The case houses sliding rods or connecting strips T1 and T2 which are actuated by electromagnet Ea and by mechanism M2, respectively and which are guided within case Br in such a way as to slide along their length, parallel to the power lines.

Sliding connecting strip T2 actuated by mechanism M2 can take three positions: an on position, an off position and a tripped position, as a function of the "On", "Off" and "Tripped" state of the apparatus. This strip carries moving actuators such as T2*a* whose position is representative of the state (on-rest-tripped) of control mechanism Sm and which are able to operate electromechanical or electronic contacts.

The sliding connecting strip T1 is actuated in a translational movement by electromagnet Ea from a working position to a rest position and vice versa in accordance with the switching of this electromagnet. This connecting strip T1 carries actuators so that T1 a is able to operate electromechanical or electronic contacts.

Below the section housing electromagnet Ea, trip mechanism Dr and mechanical sub-assembly Sm, the apparatus has a protection and control module Mp which is offset and removable and is L-shaped in which one arm of the L houses current sensors Cc and the other arm houses electronics Ce.

On the outlet side of pole Pe, each current sensor Cc is connected, through connectors C4, to a section of power line Lc2 and a section of power line Lc3 in such a way as to detect the current flowing in the corresponding pole. On the inlet side of the pole, the power line is completed by a section Lc1. The output of each sensor Cc is connected to the electronic protection circuit Ce.

From the side opposite the exposed face, electronic circuit Ce communicates through connectors C3 with electromagnet Ea, and through connectors C2 with the trip mechanism Dr. Protection module Mp outputs an error signal to trip mechanism Dr when a fault current (short-circuit) is detected by a sensor Cc. Trip mechanism Dr then generates the command to open contacts Ct.

The electronic protection circuit Ce also receives a supply voltage from power supply terminals A1 and A2 arranged to be visible at the bottom of the front face of the case. These terminals are connected to conductors housed inside the case which, via connectors C5, connect to electronic circuit Ce of protection module Mp. This supply voltage applied to terminals A1 and A2 serves to power the protection module, the trip mechanism and the coil of the electromagnet.

Below the protection module Mp, there is a space which is dedicated to a communication or control module K1, which is removable and in the form of a cassette. At their rear, some K1 modules have contacts or switches ka and kb, of the electromagnetic or electronic type, which are operated by actuators T1*a* and T2*a*.

The protection module Mp has a connector C1 allowing it to communicate with module K1 arranged beneath it, according to the functionalities of this module.

Below module K1 the case can accept a module K2 dedicated to error functions and a second module K3.

Referring to FIGS. 3 to 8, the manual control button Cm, which is of the pushbutton type, serves to impart a translational movement to slider 1 to which it is mechanically linked, along a direction perpendicular to the Pc contacts bridge. A pivoting lever 2 is made to rotate by the movement of the slider and a slotted link coupling 11–21. This pivoting lever 2 which pivots about an axis 22 is coupled to one end of a helical compression spring 4 whose other end is coupled to a fixed support 41. In this way, spring 4 exerts a torque on lever 2 that tends to make it twist in the clockwise and reset direction. Oscillating lever 2 has a limit stop 23 which is intended to work in conjunction with the moving push device of trip mechanism Dr.

A cut-off lever 3 is mounted to oscillate about an axis 31 on the fixed parts. One end of it is coupled to the lower end of slider 1 and the other end can bear on the top of contact holder Ra.

A pivoting and flexible bolt 6 passes through a central elongated housing of slider 1. It has a locking projection 62 which can engage in notches 12 in the slider housing. This bolt 6 is mounted on a lever 7 which can pivot about an axis 71 and which extends a significant distance along the slider. This lever 7 has a release bearing surface 72 against which the end of the moving push device out of trip mechanism Dr can be applied. The end of lever 7 which is close to the contacts operates sliding connecting strip T2.

Bolt 6 is acted on by a tension spring which is also hooked onto a fixed point and exerts a restoring force in a clockwise direction. The flexibility of the bolt makes it possible to obtain an elastic effect at the projection 62 to which can be added the effect of a tension spring.

On the front face, the apparatus has a locking cursor Vr which can occupy two positions, one locked and the other unlocked, and which serves to pivot a rocker arm 8 which can operate connecting strip T2 and an indicator contact associated with this connecting strip. This rocker arm can pivot about an axis 31 under the action of cursor Vr. When locking cursor Vr is in the locked position it prevents extraction of the protection module. When locking cursor Vr is in the unlocked position, protection module Mp can be extracted and rocker arm 8 goes to the tilted position in such a way as to move connecting strip T2 and to operate the associated contact.

The device described functions in the following manner.

On (FIG. 3): control Cm is in the On position and slider 1 is in the lower position. Cut-off lever 3 frees contact holder Pc and contacts Ct are closed with the contact pressure. Bolt 6 is engaged in slider 1 by its projection 62. Trip mechanism Dr is held in the armed position, the push device being retracted. When the coil of electromagnet Ea is energised, a mechanism linked to the moving parts of the electromagnet opens the poles. The locking cursor Vr prohibits removal of the module Mp.

Off (FIG. 4): when the operator actuates the manual control button Cm, the projection of bolt 6 disengages from the notches of slider 1 thanks to the flexibility of the bolt, and slider 1 moves to occupy the extreme uppermost position. The multipole lever 3 twists clockwise and its end bears on contact holder Ra. The poles open.

Extraction of the protection module (FIG. 5): when locking cursor Vr is moved to the unlocked position, module Mp can be removed. Rocker arm 8 tilts and moves connecting strip T2. The contact associated with connecting strip T2 is operated.

Tripping—automatic resetting (FIG. 6): when trip mechanism Dr is actuated its push device moves and acts on bearing surface 72 of lever 7 which twists in an anticlockwise direction. Lever 7 moves the indicating connecting strip T2.

Figure 4:
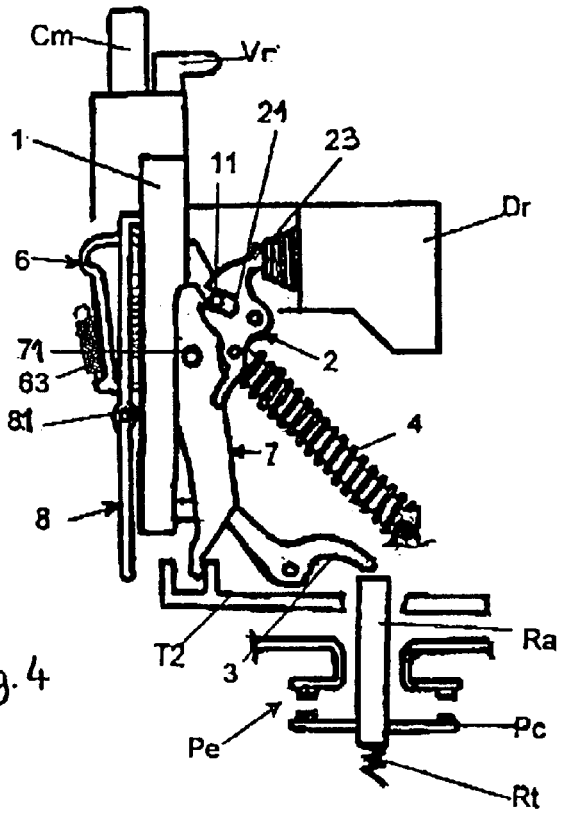
FIG. 4 represents the mechanical sub-assembly of the apparatus in the "off" state, with the protection and control module locked.
Figure 8:
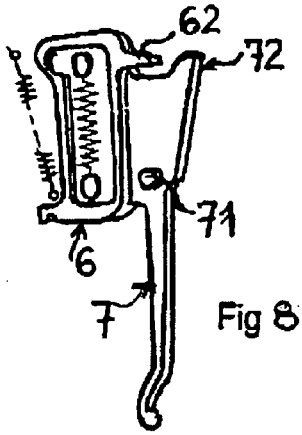
Figure 5:
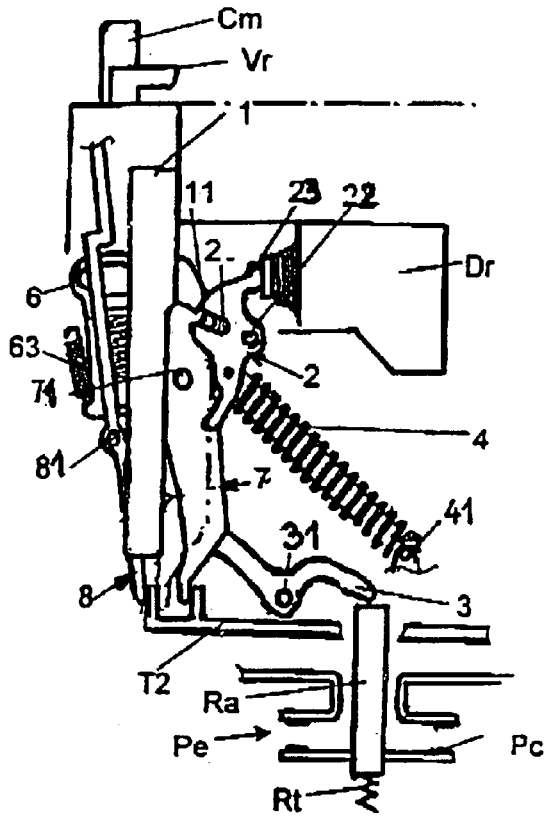
FIG. 5 represents the mechanical sub-assembly of the apparatus in the "off" state, with the protection and control module able to be extracted.
Figure 6:
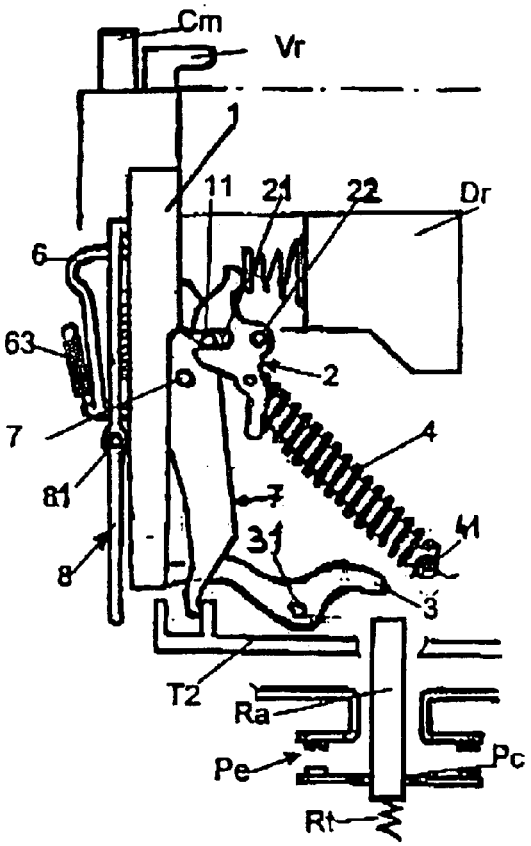
FIG. 6 illustrates the mechanical sub-assembly of the apparatus in the "tripped" state

Resetting the mechanism after it has tripped is done automatically by means of spring 4 which restores the push device of trip mechanism Dr to its retracted position. The mechanism returns to the "Off" position (FIG. 4). The operator must press control button Cm in order to switch the apparatus on again as in FIG. 3.

It is clearly understood that, without departing from the scope of the invention, it is possible to conceive of variants and detail improvements and even to consider the use of equivalent facilities.

What is claimed is:

1. Apparatus for motor protection and control comprising:

a case having a front face;

power conductors comprising poles with separable contacts;

a trip mechanism connected to an electromagnet, a mechanical device, a first connecting strip and a manual control button, a protection device comprising means for detecting currents flowing through the power conductors and means for generating an initiating signal to control the trip mechanism, the electromagnet the mechanical device, wherein said mechanical device is for actuating the separable contacts and the first connecting strip, and said manual control button is for actuating the mechanical device, wherein the mechanical device comprises means for automatically resetting the trip mechanism after the trip mechanism has tripped and means for returning the mechanical device to an OFF position.

2. The apparatus as claimed in claim 1, further comprising an indicator contact associated with the first connecting strip, a rocker arm and a locking cursor located on the apparatus face, the locking cursor for occupying a locked position preventing the protection device from being extracted from the case and an unlocked position enabling the protection device to be extracted from the case and for moving the rocker arm to actuate the first connecting strip and the indicator contact.

3. The apparatus as claimed in claim 1, further comprising a rocker arm rotatable around a rocker arm axis, and a locking cursor located on the front face of the apparatus and linked to the rocker arm.

4. The apparatus as claimed in claim 1, further comprising a slider linked mechanically to the manual control button, and a mechanical trip device comprising a pivoting control lever connected to and actuated by a spring coupled to a fixed point and the slider, wherein the mechanical trip device is for resetting said trip mechanism and actuating the slider and said manual control button, to put the mechanical trip device in an OFF position.

5. The apparatus as claimed in claim 4, wherein the manual control button is a pushbutton.

6. The apparatus as claimed in claim 4, further comprising a pivoting bolt, a lever and a second connecting strip, wherein the slider is for operating in conjunction with the pivoting bolt and the lever to actuate the second connecting strip.

* * * * *